United States Patent [19]

Matthews

[11] Patent Number: 4,593,791

[45] Date of Patent: Jun. 10, 1986

[54] AUTOMATIC SEQUENCING CIRCUIT FOR LIFT CYLINDERS

[75] Inventor: Dean A. Matthews, Homewood, Ill.

[73] Assignee: Allis-Chalmers Corporation, Milwaukee, Wis.

[21] Appl. No.: 601,255

[22] Filed: Apr. 17, 1984

[51] Int. Cl.[4] ..... B66B 9/20

[52] U.S. Cl. ..... 187/9 E; 91/517

[58] Field of Search ..... 187/9 E, 9 R, 17; 91/189 R, 512, 517

[56] References Cited

U.S. PATENT DOCUMENTS

| | | | |
|---|---|---|---|
| 3,394,778 | 7/1968 | Brinton | 187/9 E |
| 3,541,928 | 11/1970 | Conwell et al. | 187/9 E X |
| 3,587,784 | 6/1971 | Tait | 187/9 E |
| 3,967,534 | 7/1976 | Cryder et al. | 91/517 X |
| 4,349,305 | 9/1982 | Wynn et al. | 91/517 X |
| 4,369,861 | 1/1983 | Rietman | 187/9 E |

*Primary Examiner*—Joseph J. Rolla
*Assistant Examiner*—Nils E. Pedersen
*Attorney, Agent, or Firm*—Charles L. Schwab; Arthur M. Streich

[57] ABSTRACT

The carriage lift and mast lift cylinders are sequentially extended and retracted in the reverse order of pressure required to actuate them by a sequencing valve to insure proper sequential movement of the lift carriage and extension of the mast sections.

4 Claims, 2 Drawing Figures

AUTOMATIC SEQUENCING CIRCUIT FOR LIFT CYLINDERS

TECHNICAL FIELD

This invention relates to the sequencing of hydraulic lift cylinders in a lift truck mast.

BACKGROUND OF THE PRIOR ART

In a lift truck utilizing multiple section masts with a lift carriage, it has been customary to provide a hydraulic carriage lift cylinder for raising the carriage on the mast section on which it is mounted prior to raising the extensible sections of the mast by one or more hydraulic mast lift cylinders. One way to obtain proper sequencing, that is, obtaining an initial lift of the carriage relative to its supporting section prior to raising the extensible mast sections, is to employ special latches which effect proper sequencing of the carriage and mast sections. A second method of obtaining proper sequencing is the use of sequencing valves which sequence first to the lower pressure responsive cylinder and then to the cylinder requiring higher pressure for actuation. The use of latches has not proven entirely satisfactory because of excessive wear, breakage and malfunction. The sequencing valves previously employed are not satisfactory in a hydraulic system for a mast whose carriage lift cylinder requires greater pressure to raise the carriage than is required for causing extension of a pair of cylinders operating to raise the extensible mast sections. Such a mast is shown in U.S. Pat. No. 4,369,861 to David W. Rietman entitled "Multiple Section Mast With A Pair of Lift Jacks Behind the Primary Section Uprights" issued Jan. 25, 1983. In the mast of U.S. Pat. No. 4,369,861, a pair of three-element cylinders is placed behind the primary uprights to effect raising of the extensible mast sections and a single cylinder is used for raising the carriage on the inner mast section. The effective pressure area provided by the pair of three-element cylinders to raise the extensible mast sections is substantially greater than the effective pressure area provided by the single cylinder used to raise the carriage. Thus, when the pair of three-element cylinders are actuated by a pressure fluid circuit connecting them in parallel with the carriage cylinder, the pair of three-element cylinders will extend the mast before the carriage operating cylinder raises the carriage. This, of course, is an improper sequence for lift truck work assignments, such as storing and retrieving in low ceiling areas.

OBJECTS AND SUMMARY OF THE INVENTION

The primary object to the present invention is to provide a lift cylinder selector circuit for a lift truck mast employing separate carriage lifting and mast section operating cylinders wherein the carriage cylinder is automatically pressurized to lift the carriage prior to extension of the mast operating cylinders even though the effective pressure area of the mast operating cylinders is substantially greater than the effective pressure area of the carriage cylinder.

In summary, the present invention has utility in a lift truck having a mast with a stationary section and an extensible section and with a vertically reciprocal load carriage on the extensible mast section and having a hydraulic lift system for raising the load carriage relative to the extensible mast section and for raising the extensible mast section relative to the stationary section. The hydraulic lift system includes extensible and contractible hydraulic carriage lift cylinder means of a first predetermined effective pressure area mounted on the extensible mast section and operatively connected to the carriage so as to cause raising and lowering of the carriage upon extension and contraction, respectively, of the carriage lift cylinder means and also includes extensible and contractible hydraulic mast lift cylinder means of a second predetermined effective pressure area mounted on the stationary mast section and operatively connected to the extensible mast section so as to cause raising and lowering of the latter upon extension and contraction, respectively, of the mast lift cylinder means, the mast lift cylinder means having a substantially greater effective pressure area than the carriage lift cylinder means. Further, the hydraulic lift system includes a hydraulic pressure fluid control for the cylinder means including a source of pressure fluid, a control valve having lift, lower and hold conditions of adjustment and sequencing valve means for operating the cylinder means in a predetermined sequence. The sequencing valve means has a raising mode wherein the carriage lift cylinder is extended to raise the carriage on the extensible mast section and then the mast lift cylinder means is extended to raise the extensible mast section and has a lowering mode wherein the mast lift cylinder means is contracted to lower the extensible mast section and then the carriage lift cylinder means is contracted to lower the carriage on the extensible mast section.

BRIEF DESCRIPTION OF THE DRAWINGS

One embodiment of the present invention is shown in the drawings in which.

DETAILED DESCRIPTION OF THE INVENTION

The lift cylinder selector circuit of the present invention finds particular utility in the lift truck mast illustrated in the beforementioned U.S. Pat. No. 4,369,861 to David W. Rietman, "Multiple Section Mast With a Pair of Lift Jacks Behind The Primary Section Uprights", issued Jan. 25, 1983, the disclosure of which is incorporated herein by reference.

Figure 1:
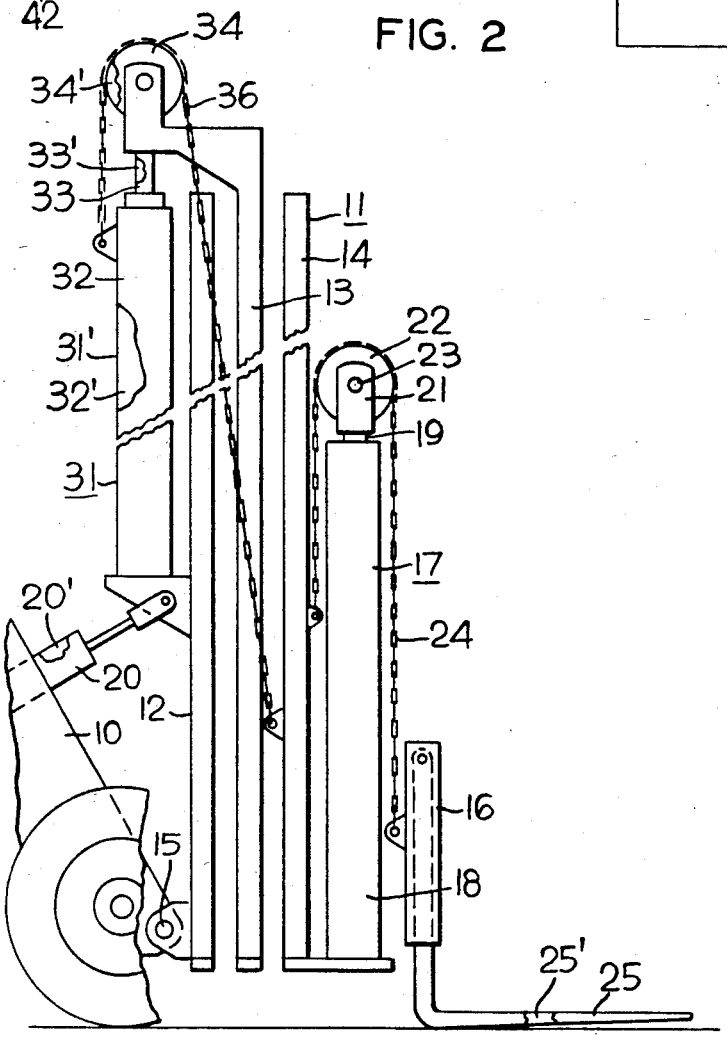
FIG. 1 PRIOR ART
FIG. 1 is a somewhat schematic side view of a lift truck mast in which the present invention has utility.

FIG. 1 is a schematic illustration of the lift truck mast shown in the beforementioned U.S. Pat. No. 4,369,861. The mast 11 shown in FIG. 1 includes an outer stationary or nonextensible section 12 which has uprights pivotally supported on the frame 10 of the lift truck by transverse pivot pins 15, only one of which is shown. A pair of tilt cylinders 20, 20' control the tilting of the mast. The mast 11 also includes an extensible intermediate section 13 and an extensible inner section 14. Conventional means such as rollers are used to interconnect the channel and I-beam uprights of the mast sections and to support a carriage 16 on the inner mast section 14. The carriage 16, which includes a pair of forks 25, 25', is raised and lowered in relation to the inner mast section 14 by a single acting hydraulic carriage cylinder 17 whose cylinder component 18 is supported at its lower end on the inner mast section 14. A rod element 19 of the carriage cylinder 17 extends from the upper end of the cylinder component 18 and includes a clevis 21 at its upper end on which a pulley 22 is rotatably mounted by a transverse pin 23. A chain 24 is reeved over the pulley 22 and has a first end anchored to the inner mast section 14 and a second end secured to the rear of the lift carriage 16. A pair of three-element hydraulic lift cylinders 31, 31' have the lower ends of their outer cylinder components 32, 32' mounted on the stationary mast section 12 and the upper ends of their rod components 33, 33' connected to the upper end of the secondary mast section 13. A pair of pulleys 34, 34' are rotatably supported at the upper end of the intermediate mast section 13 and carry a pair of lift chains 36, only one of which is shown. First corresponding ends of the lift chains are connected to the outer cylinder elements 32, 32' of lift cylinders 31, 31' and the second corresponding ends of the chains 36 are connected to the uprights of the inner mast section 14. The rod elements 33, 33' of the cylinders 31, 31' have their upper ends secured to the intermediate mast section 13. When the hydraulic actuators 31, 31' are extended, the intermediate mast section 13 is raised at the speed of extension of the single acting lift cylinders 31, 31' and the inner mast section 14 is raised at twice the speed of the extension of the lift cylinders 31, 31'.

Figure 2:
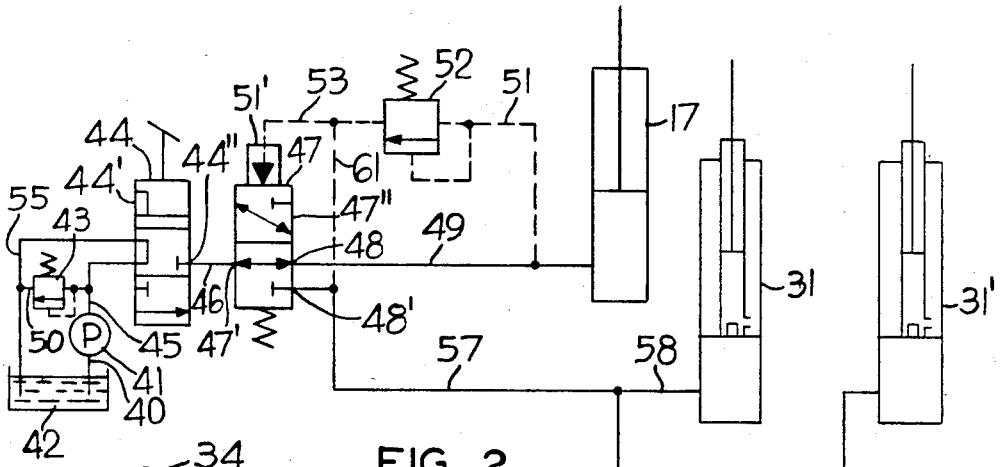
FIG. 2 is a schematic illustration of the automatic sequencing circuit for the lift cylinders of the lift truck illustrated in FIG. 1.

Referring also to FIG. 2, the combined effective pressure area of mast lift cylinders 31, 31' is substantially greater than the effective pressure area of the single carriage lift cylinder 17. Accordingly, if the carriage cylinder 17 was conventionally connected in parallel with the mast lift cylinders 31, 31', the mast lift cylinders 31, 31' would extend first. Such sequencing is the reverse of what is desired and eliminates "free lift", that is, the initial lift of the carriage without upward extension of the mast sections.

The hydraulic control system of the present invention, schematically illustrated in FIG. 2, includes a pump 41, a fluid reservoir 42 and a relief valve 43 together with a manually operated control valve 44 located at the operator's station, not shown. The pump 41 draws fluid from the reservoir 42 by a conduit 40 and delivers fluid to the control valve 44 by a delivery conduit 45. The relief valve 43 is disposed in a conduit 50 interconnecting delivery conduit 45 and a return to reservoir conduit 55. The illustrated hydraulic control system provides automatic sequencing of the carriage and mast lift cylinders when the operator moves the flow control element 44' of the manually operated control valve 44 upward from its illustrated hold position to its raise or lift position. In the raise position of the hydraulic control valve element 44', pressure fluid is delivered to a port 47' of a pilot operated selector valve 47 by hydraulic fluid supply conduit 46 interconnecting a fluid supply port 44'' of the control valve and port 47'. Initial output of fluid from the pilot operated selector valve 47 will be from its supply port 48 to a fluid delivery conduit 49 connected to the carriage lift cylinder 17 for lifting the lift truck carriage through its "free lift" range, that is, to the top of the inner mast section 14.

When the carriage lift cylinder 17 extends to the end of its stroke, the pressure will rise in conduit 49 and also in a pilot conduit 51 interconnecting fluid conduit 49 with an actuator 51' at the upper end of the flow control element 47'' of the selector valve 47. A relief valve 52 is operatively interposed in the pilot conduit 51 and has a lower relief pressure than pump relief valve 43. When relief valve 52 opens, for instance at a pressure of 2,000 pounds per square inch, pressurized fluid flows through outlet conduit 51 including its downstream segment 53 to the actuator 51' of the pilot operated selector valve 47, thereby causing the flow control element 47'' to move downwardly from its illustrated carriage cylinder supply position to its piloted operated or mast lift cylinder supply position wherein the fluid supply conduit 46 is placed in fluid communication with a supply fluid conduit 57 connected to mast lift cylinders 31, 31' through branch fluid conduits 58, 59 by virtue of the internal passage in the flow control element 47'' now positioned between the port 47' and a supply port 48'. A pilot or holding fluid conduit 61 interconnecting conduit segment 53 and conduit 57 subjects the downstream portion 53 of selector valve pilot conduit 51 to the fluid pressure in parallel connected mast lift cylinders 31, 31' thereby holding the selector valve 47 in its shifted or mast lift cylinder supply position. The pressure required to operate the selector valve 47 is substantially lower than the relief pressure of relief valve 52. For instance, the pilot valve 47 is shifted when its actuator is subjected to a pressure of 50 pounds per square inch. After the selector valve element 47'' is shifted downwardly to its mast lift cylinder supply position, the relief valve 52 will close.

When the mast has been extended to the desired height, the control valve 44 is manually shifted to its central hold position. In the hold position of the control valve 44, the pressure in the mast lift cylinders will hold the selector valve 47 in its alternate mast lift cylinder supply position. If the manual control valve 44 is next shifted downwardly to its mast lower position, conduits 57, and hence cylinders 31, 31' will be connected to the reservoir return conduit 55. The pressure in conduit 57 during contraction of cylinders 31, 31' will be of a sufficient value to keep the selector valve 47 in its mast cylinder supply position and thus the mast sections will be completely retracted before the carriage is lowered on the inner mast section 14. When extensible mast sections have been lowered, which coincide with the complete retraction of lift cylinders 31, 31', the pressure in conduit 57 will drop to a near zero value and the spring biased flow control element 47'' of the selector valve 47 will return to its illustrated position in which the carriage lift cylinder 17 is connected to conduit 46, thus connecting the carriage lift cylinder 17 to the reservoir 42 to cause the carriage to lower to its lowered position illustrated in FIG. 1. Thus, the selector circuit or sequencing mechanism of the present invention not only provides proper sequencing of the mast and carriage lift cylinders in the mast raising mode but also in the mast lowering mode.

Each lift truck is designed for a maximum or rated load. The relief valve 52 should be selected to provide a relief pressure at about the pressure at which the carriage lift cylinder would be lifting a rated load. This pressure would be lower than the relief pressure of the main or pump relief valve 43. In event the operator attempts to lift a load heavier than the rated load, the relief valve 43 will open before the carriage lift cylinder is extended thereby causing the selector valve to shift to a mast cylinder supply position. The result is an improper sequencing. Thus, when an improper sequencing occurs, this becomes a signal to the operator that he is attempting to lift a load heavier than the rated capacity.

The embodiment of the invention in which an exclusive property or privilege is claimed are defined as follows:

1. In a lift truck having a mast with a stationary section and an extensible section and with a vertically reciprocal load carriage on the extensible section, a hydraulic lift system for raising the load carriage relative to the extensible section and the extensible section relative to the stationary section comprising extensible and contractible hydraulic carriage lift cylinder means having a first predetermined effective pressure area mounted on said extensible mast section and operatively connected to said carriage so as to cause raising and lowering of said carriage upon extension and contraction, respectively, of said carriage lift cylinder means, extensible and contractible hydraulic mast lift cylinder means having a second predetermined effective pressure area mounted on said stationary mast section and operatively connected to said extensible mast section so as to cause raising and lowering of the latter upon extension and contraction, respectively, of said mast lift cylinder means, said mast lift cylinder means having a substantially greater effective pressure area than said carriage lift cylinder means, and a hydraulic pressure fluid control for said cylinder means including a source of pressure fluid, a control valve having raise, lower and hold positions of adjustment, sequencing valve means for operating said cylinder means whereby in the raise position of said control valve said carriage lift cylinder is extended to raise said carriage on said extensible mast section and then said mast lift cylinder means is extended to raise said extensible mast section and in the lower position of said control valve said mast lift cylinder means is contracted to lower said extensible mast section and then said carriage lift cylinder means is contracted to lower said carriage on said extensible mast section, said sequencing valve means includes a pilot operated selector valve having a first position of adjustment in which it directs hydraulic pressure fluid to said carriage lift cylinder means until a first predetermined fluid pressure is reached in said carriage lift cylinder means at which time said pilot operated selector valve automatically moves to a second position of adjustment in which it directs hydraulic pressure fluid to said mast lift cylinder means but not to said carriage lift cylinder means, and said sequencing valve means additionally includes a latching circuit means interconnecting said mast lift cylinder means and said selector valve for maintaining said selector valve in its second position of adjustment so long as the fluid pressure in said mast lift cylinder is above a predetermined minimum pressure which pressure is substantially lower than said first predetermined pressure.

2. The lift truck of claim 1 wherein said sequencing valve means includes a pilot conduit between said carriage lift cylinder means and said pilot operated selector valve, a relief valve in said pilot conduit opening at said first predetermined fluid pressure and wherein said latching circuit means includes a conduit interconnecting said mast lift cylinder means and said pilot conduit downstream of said relief valve.

3. In a lift truck mast having a carriage mounted for vertical reciprocal movement on an extensible section of the mast, extensible carriage lift cylinder means mounted on the extensible section and operable to raise and lower said carriage and extensible mast lift cylinder means mounted on a nonextensible section of the mast and operable to raise and lower said extensible section and wherein the effective pressure area of said carriage lift cylinder means is substantially less than the effective pressure area of said mast lift cylinder means, a fluid control system for said carriage and mast lift cylinder means having a lifting mode wherein said carriage lift cylinder is extended to raise said carriage on said extensible section before said mast lift cylinder means is extended to raise said extensible section and a lowering mode, wherein said mast lift cylinder means is contracted to lower said extensible section before said carriage lift cylinder means is contracted to lower said carriage on said extensible section, said control system comprising:

a manual control valve having a flow control element shiftable between raise, hold and lower positions, a source of fluid pressure including a reservoir and a pump drawing fluid from said reservoir and connected in pressure fluid delivering relation to said control valve a fluid return line interconnecting said control valve and said reservoir a relief valve for said pump having a predetermined relief pressure at which pump output is bypassed to said reservoir, a pilot operated selector valve having an input port connected to said control valve and having first and second output ports connected to said carriage lift cylinder means and said mast lift cylinder means, respectively, said selector valve having a shiftable flow control element which is movable between a first condition of adjustment in which pressure fluid is directed to said first output port but not to said second output port and a second condition of adjustment in which pressure fluid is directed to said second output port but not to said first output port, a first fluid conduit connecting said first output port to said carriage lift cylinder means, a second fluid conduit connecting said second output port to said mast lift cylinder means, a pilot conduit interconnecting said first fluid conduit and said pilot operated selector valve, a second relief valve in said pilot conduit having a predetermined relief pressure lower than said relief pressure of said first relief valve, and a holding fluid conduit interconnecting said second fluid conduit and said pilot conduit downstream of said second relief valve, said selector valve flow control element being moved to said second position of adjustment when said second relief valve opens and also when the fluid in said second fluid conduit is above a third predetermined pressure which is substantially below said relief pressure of said second relief valve.

4. In a hydraulic control system comprising first and second extensible hydraulic lift cylinder means wherein said first cylinder means requires a higher fluid pressure for its extension than is required for extension of said second cylinder means and a fluid control system for sequentially operating said cylinder means including a source of pressure fluid, a control valve having raise, lower and hold positions of adjustment operatively associated with said source of fluid pressure and having a fluid supply port, a pilot operated selector valve having a fluid supply port connected to said fluid supply port of said control valve and having first and second output ports, a first conduit connecting said first output port in fluid communication with said first lift cylinder means, a second conduit connecting said second output port with said second lift cylinder means, a pilot conduit interconnecting said first conduit with said selector valve, said selector valve having a normal position in which said supply port of said control valve is in fluid communication with said first lift cylinder means and a pilot operated position in which said control valve supply port is connected to said second lift cylinder means, a relief valve in said pilot conduit opening at a first predetermined pressure thereby causing said selector valve to shift to its pilot operated position, and a holding circuit including a conduit interconnecting said second conduit and said pilot conduit downstream of said relief valve.

* * * * *